US005178456A

United States Patent [19]

Marconnet

[11] Patent Number: 5,178,456

[45] Date of Patent: Jan. 12, 1993

[54] DEVICE FOR THE PREPARATION OF BITUMINOUS COATED PRODUCTS COMPRISING A DRUM WITH PARALLEL STREAMS AND A COUNTERCURRENT DRUM AND CORRESPONDING PROCESS

[75] Inventor: Guy Marconnet, Rive de Gier, France

[73] Assignee: Ermont C. M., Lorette, France

[21] Appl. No.: 620,862

[22] Filed: Dec. 4, 1990

[30] Foreign Application Priority Data

Jan. 18, 1990 [FR] France ..... 90 00569

[51] Int. Cl.[5] ..... B28C 5/08; B28C 5/46

[52] U.S. Cl. ..... 366/25; 366/134; 34/136; 34/137; 432/106

[58] Field of Search ..... 366/22, 23, 24, 25, 366/134; 432/106, 110, 118; 34/135, 136, 137

[56] References Cited

U.S. PATENT DOCUMENTS

| | | | |
|---|---|---|---|
| 3,809,373 | 5/1974 | Brock | 366/22 |
| 4,142,803 | 3/1979 | Mendenhall | 366/25 |
| 4,481,039 | 11/1984 | Mendenhall | 366/25 |
| 4,540,287 | 9/1985 | Servas et al. | 366/25 |
| 4,555,182 | 11/1985 | Mendenhall | 366/23 |
| 4,626,198 | 12/1986 | Cohen | 432/106 |
| 4,705,404 | 11/1987 | Brüggemann | 366/25 |
| 4,715,720 | 12/1987 | Brock | 366/22 |
| 4,910,540 | 3/1990 | Murray | 366/23 |

FOREIGN PATENT DOCUMENTS

| | | |
|---|---|---|
| 0216316 | 4/1987 | European Pat. Off. . |
| 0347281 | 12/1989 | European Pat. Off. . |
| 2441682 | 11/1978 | France . |

*Primary Examiner*—Harvey C. Hornsby
*Assistant Examiner*—R. Alexander
*Attorney, Agent, or Firm*—Pollock, Vande Sande & Priddy

[57] ABSTRACT

The device comprises a drum drier with parallel streams (1) fed with recycled materials and a drum drier and countercurrent mixer (2) fed with virgin aggregates at its entry end (2*a*). The exit end (1*b*) of the drum with parallel streams (1) through which the dried and preheated recycled materials leave is connected to a ring (26) for introducing materials through the side wall of the countercurrent drum (2) through a chute for transferring the recycled materials. The ring (26) for introducing the recycled materials opens into a recycling and mixing zone (23) situated in the countercurrent drum (2) around the body of the burner (10), between the flame zone (22) and the mixing zone (24). The dried and heated recycled materials (8) are transferred continuously into the recycling zone (23) of the countercurrent drum (2).

8 Claims, 5 Drawing Sheets

DEVICE FOR THE PREPARATION OF BITUMINOUS COATED PRODUCTS COMPRISING A DRUM WITH PARALLEL STREAMS AND A COUNTERCURRENT DRUM AND CORRESPONDING PROCESS

FIELD OF THE INVENTION

The invention relates to a device for preparing bituminous coated products, in particular products intended for road dressing, from recycled bituminous materials, virgin aggregates and liquid bitumen, comprising a drum with parallel streams and a countercurrent drum. The invention also relates to a process for preparing bituminous products employing a first drum with parallel streams and se drum.

BACKGROUND OF THE INVENTION

Plants prepare bituminous coated products for road dressings from recycled bituminous materials, virgin aggregates and liquid bitumen; these comprise a single drum in which the drying and heating of the solid materials, the incorporation of liquid bitumen in these materials and their mixing to obtain the bituminous coated products at the drum exit are carried out.

The drum, which comprises a cylindrical casing arranged with its lengthwise axis slightly inclined relative to the horizontal and mounted for rotation about this axis, may have passing through it a hot gas stream traveling between the material entry end and the drum exit end in the same direction as the solid materials. To permit recycled materials to be introduced, such a drum, generally called a parallel-stream drum, comprises a recycling ring arranged around the drum casing, which is provided with devices for introducing materials through its side wall, at the recycling ring. The recycling ring is situated in a region of the drum which is distant from its entry end through which cold virgin aggregates are introduced and through which a burner enters, ensuring the travel of hot gases in the drum, in the direction of travel of the solid materials.

Although the introduction of bituminous recycled materials and the incorporation of liquid bitumen in the solid materials, which is carried out downstream of the recycling ring, are carried out in a region which is relatively distant from the burner flame, inside the drum the materials containing bitumen are exposed to hot gases capable of producing some thermal degradation of these bituminous materials and the formation of blue smoke due to bitumen vaporization.

Also known are drums designed as counter current drums, which comprise a burner which has an elongate body entering through the exit end of the drum, so that the end of the burner body at which the flame is formed opens into a region of the drum which is distant from its exit end and from its entry end. In such a countercurrent drum, cold virgin aggregates can be introduced through the entry end of the drum, these cold aggregates then traveling in a first zone of the drum forming a drying and heating zone, countercurrentwise relatively to the travel of the hot gases originating from the zone situated inside the drum, in which the burner flame is developed. The liquid bitumen incorporated in the solid materials is introduced through the outlet end of the drum into a mixing zone situated around the burner body, downstream of the flame zone. The hot gases which travel in the drum between the flame zone and the entry end of the drum are therefore do not bass through the mixing zone.

Recycled bituminous materials can be introduced into the drum by a recycling ring situated level with the flame zone or slightly downstream of this zone.

In such a drum, the heat needed for the drying, heating and melting of the bitumen of the recycled materials is brought in solely by the virgin aggregates, which are mixed with the recycled materials before the incorporation of liquid bitumen.

Even in the case where operation of the drum results in considerable superheating of the virgin aggregates, it is not possible to incorporate a very large quantity of recycled, materials into these aggregates. The incorporation of recycled materials must be generally limited to a weight proportion of the order of 40% relative to the total weight flow of solid materials traveling in the drum. The incorporation of large quantities of recycled materials into the virgin aggregates becomes still more difficult in the case where the recycled materials are very wet, because a large quantity of energy must then be supplied to these recycled materials to vaporize the water which they contain. The incorporation of the recycled materials must then be limited to percentages well below 40% of the total weight flow of the solid materials.

To overcome these disadvantages it has been proposed to employ complex plants comprising a first drum drier with parallel streams, into which the cold and wet recycled materials are introduced, and a second, countercurrent drum, through the entry end of which the virgin aggregates are introduced.

The virgin aggregates and the dried and heated recycled materials recovered at the exit of the countercurrent drum, and of the parallel-stream drum respectively, are then introduced into a stationary mixing device in which the incorporation of the liquid bitumen and possibly of other additives is carried out. The gases for drying the recycled materials, which may contain a certain proportion of bitumen vapor, can be taken from the exit of the parallel-stream drum to be introduced into the countercurrent drum in the region of the burner flame.

Such devices are relatively complex and require the use of a stationary mixer such as a parallel-shaft mixer and of a set of means for storing and measuring out the solid materials before they are introduced into the mixer.

SUMMARY OF THE INVENTION

It is therefore an object of the invention to purpose a device for preparing bituminous coated products from recycled bituminous materials, virgin aggregates and liquid bitumen, comprising a drum drier with parallel streams which has an entry end fed with recycled materials and an exit end for dried and heated recycled materials, a countercurrent drum drier and mixer which has an entry end fed with cold virgin aggregates and comprising an elongate burner entering the drum via its exit end and opening into a flame zone which is distant from the ends of the drum, a ring for introducing materials into the drum through its side wall and a mixing zone into which a device for injecting bitumen opens and which is situated around the body of the burner in the end part of the drum, close to the exit end away from the entry end through which the virgin aggregates are introduced, this device making it possible to incorporate large quantities of recycled materials in the aggregates, while being simple in structure, avoiding the use of a stationary mixer and of complex means for storing and measuring out.

To this end, the exit end of the drum with parallel streams, through which the dried and heated recycled materials leave, is connected to the introduction ring by a means for transferring materials, the ring for introducing recycled materials opening into a zone for mixing the recycled materials and the superheated virgin aggregates, which is situated in the countercurrent drum around the body of the burner between the flame zone and the mixing zone.

The invention also relates to a process for preparing bituminous coated products from recycled materials, virgin aggregates and liquid bitumen, employing a first drum with parallel streams and a second, countercurrent drum.

BRIEF DESCRIPTION OF THE DRAWINGS

To aid in understanding the invention, a description will now be given, by way of example, with reference to the appended drawings, of several embodiments of a device for preparing bituminous materials according to the invention.

DESCRIPTION OF PREFERRED EMBODIMENTS

Figure 1:
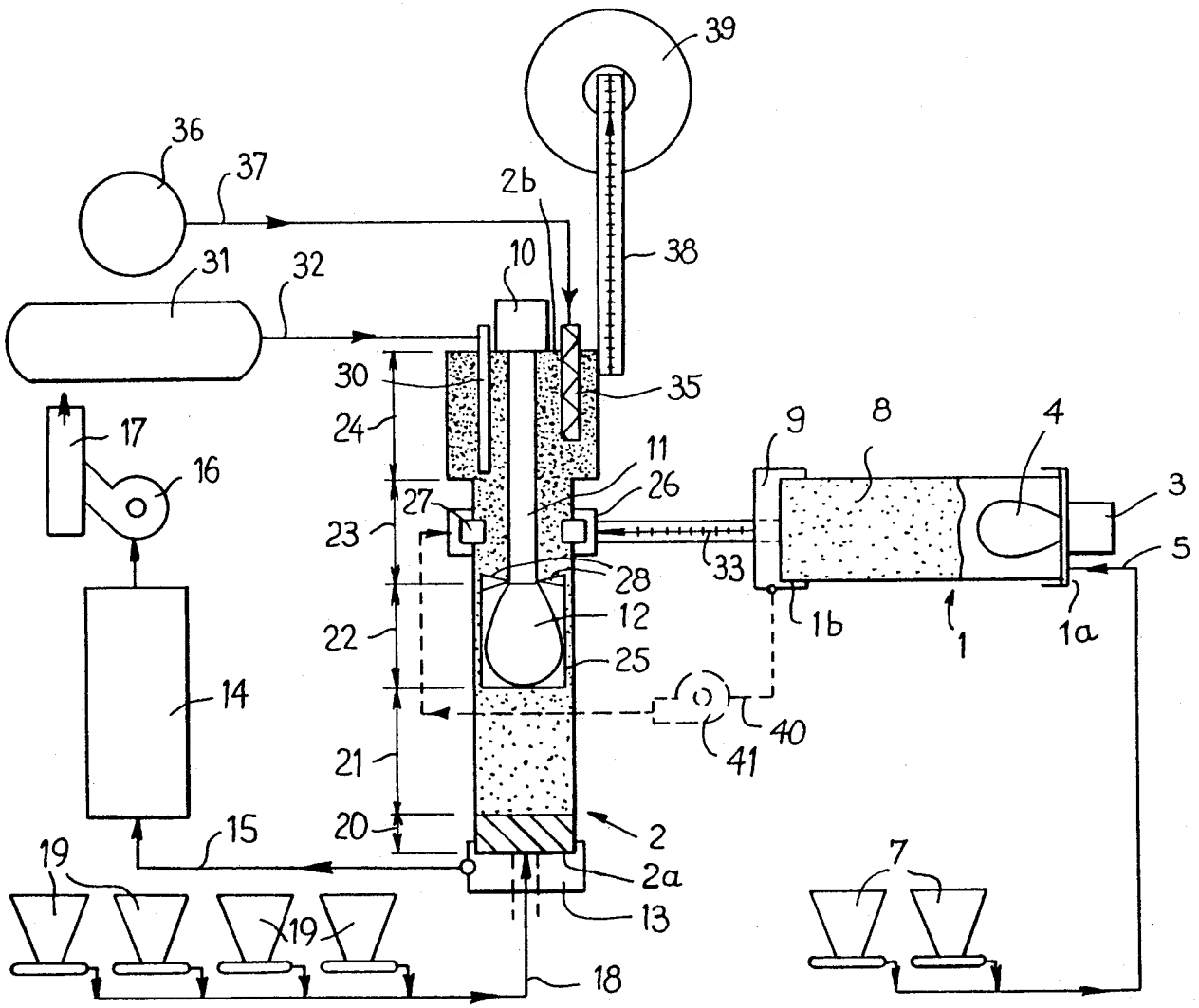
FIG. 1 is a schematic view of a plant for the preparation of bituminous materials, comprising a device in accordance with the invention.

FIG. 1 shows a plant for preparing bituminous coated materials comprising a first drum 1 of the type with parallel streams and a second drum 2 of the type with countercurrent travel.

Drum 1 comprises a casing of cylindrical overall shape whose longitudinal axis is arranged at a slight inclination relative to the horizontal plane. The drum 1 comprises an entry end 1*a* situated at a level which is higher than its exit end 1*b*; a burner 3 enters through this entry end so that the flame 4 of the burner is developed in the entry part of the drum 1 and so that the hot gases originating from the flame of the burner travel from the entry end la towards the exit end 1*b* of the drum.

Through the end la of the drum are introduced, by means of a handling device shown schematically by the arrow 5, recycled bituminous materials originating from measuring hoppers 7 and conveyed by handling means as far as the device 5 ensuring the introduction of the recycled materials into the drum.

In its initial part, the drum 1 comprises screen-vanes responsible for conveying the materials introduced into the drum, in contact with the inner wall of the drum, so as to avoid thermal degradation of the recycled materials due to direct contact with the flame or due to its radiation effect.

The recycled materials 8 in the form of particles are then set in motion and lifted inside the drum 1 by virtue of lifting vanes integrally attached to the inner wall of the drum, when the drum is set in rotation around its longitudinal axis.

A drum operating according to this principle is described in FR-A-2,441,682. The recycled materials 8 travel along the entire length of the drum 1, between its entry end 1*a* and its exit end 1*b*, in the same direction as the hot gases originating from the entry zone in which the flame 4 is developed, and are brought into contact with these gases, so that the particles 8 may be dried and heated before overflowing into a device 9 ensuring the recovery of the solid matter and of the gases at the exit of the drum 1.

The drum 2 comprises a casing of overall cylindrical shape, whose longitudinal axis is slightly inclined relative to the horizontal plane, around which the casing is mounted rotatably. The drum 2 comprises a first or entry end 2*a* and a second or exit end 2*b*, the solid materials traveling inside the drum from its entry end, towards its exit end which is situated at a lower level than the entry end.

The drum 2 comprises a burner 10 which has an elongate body, mounted inside a cylindrical casing 11 arranged along the axis of the drum 2.

The casing 11 is integrally fixed to the casing of the drum 2, with which it is driven in rotation, the burner 10 being mounted on the stationary supporting structure of the drum and introduced with clearance by means of its elongate body inside the casing 11, so that its end opens into the drum at the end of the casing 11 and produces a flame 12 in the internal space of the drum. The end of the casing 11 and of the body of the burner at which the flame 12 is produced is situated in a region of the drum which is distant from the entry end 2*a* and from the exit end 2*b*.

Hot gases originating from the region where the flame 12 is produced travel in the direction of the entry end 2*a* of the drum and are trapped at this end by a manifold 13 connected to means for treating and discharging the gases. These means comprise a dust extractor 14 connected to the manifold 13 by means of a conduit 15 and a fan 16 situated at the exit of the dust extractor, drawing the gases through the dust extractor and ensuring the recovery of the purified gases, which are discharged at the exit of the fan 16 via a stack 17 which is open to the atmosphere.

At its entry end 2*a* the drum 2 is fed with cold and wet aggregates, by virtue of a weighing conveyor 18 onto which aggregates of various particle sizes, originating from measuring hoppers 19, are poured in controlled quantities.

The internal surface of the casing of the drum 2 is fitted with vanes for conveying and/or lifting the solid materials, whose shape varies along the length of the drum. In the entry part of the drum, following the end face 2*a*, into which opens the device for handling and introducing the cold and wet aggregates, the inner surface of the drum is fitted with helically wound vanes permitting rapid introduction, without lifting, of the materials into the drum. Following this first introduction zone 20, the drum comprises a drying zone 21 in which the inner surface of the drum is fitted with lifting vanes responsible for lifting the aggregates and allowing them to fall back again throughout the cross-section of the drum, so as to ensure good contact between the aggregates and the hot gases traveling in the drum between the flame zone 22 in which the flame of the burner 12 is developed and the entry end 2*a*.

In the flame zone 22, the inner surface of the drum is fitted with screen-vanes 25 allowing the aggregates to be kept traveling in the drum against the inner wall of the drum casing, so as to distance them from the flame 12 and to protect them against the flame radiation.

Following the flame zone 22, the drum 2 comprises a recycling and mixing zone 23 at which the drum casing is surrounded by a recycling ring 26 allowing recycled materials to be introduced into the drum.

For this purpose, the drum casing comprises, level with the recycling ring 26, passage openings and chutes 27 which allow the recycled materials introduced into the stationary ring 26 to be guided and introduced into the space inside the drum.

In the zone 23, the inner surface of the drum is fitted with vanes permitting effective stirring and mixing of the solid materials traveling in the drum.

Between the end part of the casing 11 and the inner surface of the drum are fixed radially directed fins 28 with an inclination of less than 90° relative to the longitudinal axis of the drum.

When the drum rotates, the assembly consisting of the drum casing, the burner casing 11 and the fins 28 is set in rotation, the fins 28 then behaving like the fins of a turbine allowing the gases formed in the recycling and mixing zone 23 to be drawn in and delivered into the flame zone 22.

Between the zone 23 and the exit end 2*b*, the drum 2 comprises a mixing zone 24, into the entry of which opens a bitumen injection lance 30 connected to a liquid bitumen storage tank 31 by means of a conduit 32.

The casing of the drum 2 in the zone 24 has a diameter which is greater than the diameter of the running part of the drum. The inner surface of this diametrally widened part of the casing is fitted with vanes ensuring lifting and dropping back of the solid materials throughout the cross-section of the drum, so as to perform the mixing of the liquid bitumen and of the solid materials and to ensure that these materials are well coated.

The zones 23 and 24 occupy the part of the internal space of the drum 2 which is situated at the periphery of the casing 11 in which the body of the burner 10 is placed.

According to the invention, the outlet manifold 9 of the drum 1 is connected to the recycling ring 26 via a means of transfer 33 responsible for conveying the recycled materials between the exit of the drum drier 1 and the recycling ring 26.

As will be explained in greater detail with reference to FIGS. 3 and 4, the means of transfer 33 may consist of a simple spillway chute or a conveyor, e.g. a conveyor with scraper blades.

Various additions of materials may be carried out in the mixing zone 24. FIG. 1 shows a screw conveyor 35 fed with pulverulent substance from a storage hopper 36 via a handling means 37. The device 35 allows a pulverulent substance to be introduced in a metered quantity into the bituminous mixes during the mixing. In fact, to obtain bituminous mixtures of good quality, the pulverulent substance (filler) content of these bituminous mixes must be controlled.

The bituminous mixes produced in the drum 2 overflow at the exit of the zone 24 onto a conveyor 38, e.g., a conveyor with scraper blades, to be poured into a storage hopper 39.

The manifold 9 connected to the exit of the drum drier 1 and responsible for the recovery of the recycled materials and of the gases traveling in the drum 1 is connected to the recycling ring 26 by a conduit 40 in which a suction fan 41 is fitted. The gases which have traveled through the drum drier 1 can thus be reintroduced into the drum 2 at the level of the zone 23, by means of the recycling ring and the openings and chutes passing through the drum casing.

The operation of the device shown in FIG. 1, permitting the preparation of bituminous mixes incorporating a high proportion of recycled materials according to the process of the invention, will now be described.

The cold and wet recycled materials originating from the measuring hoppers 7 are introduced into the drum 1 through its end la and are kept against the inner wall of the drum by screen-vanes in its initial part where the flame 4 is produced, as indicated above. The recycled materials cannot therefore come into direct contact with the flame and are equally protected against its radiation. Thermal degradation of the bitumen coating the particles of recycled materials is thus avoided.

Downstream of the entry part of the drum drier 1, in which the flame 4 is developed, the recycled materials are lifted by lifting vanes and fall back again throughout the cross-section of the drum, so as to come into contact with the hot gases produced by the flame 4 of the burner and traveling in the same direction as the particles of recycled materials 8.

In this way the particles 8 of recycled materials are dried and heated, with the result that the particles which spill over into the manifold 9 no longer contain water in any appreciable quantity and are at a temperature of the order of 100°C.

These particles, dried and heated to a temperature close to 100°C., are taken over by the handling device 33 and poured continuously into the recycling ring 26 and then, through the chutes 27, into the zone 23 of the drum 2.

The virgin aggregates introduced into the entry part of the drum 2 via the handling device 18 are dried and heated in the zone 21 so that, on leaving the zone 21, these virgin aggregates no longer contain any appreciable quantity of water and are at a temperature which is well above 100°C. On leaving the zone 21 and in the flame zone 22, the virgin aggregates are superheated by contact with gases at very high temperature, originating from the flame 12, and by heat conduction through the screen-vanes 25.

The superheated aggregates are incorporated into, and then mixed with, the recycled materials inside the zone 23.

Inside the drum drier 1, the particles 8 of recycled materials come into contact with gases originating from the flame 4 of the burner, which may be at a high temperature. These gases can produce some vaporization of the bitumen coating the particles.

The gases reaching the manifold 9 at the exit of the drum drier 1 are therefore liable to contain a certain proportion of vapors of hydrocarbons of formula $CH_x$, formed by evaporation and thermal decomposition of the bitumen present in the recycled materials.

These gases are recovered in the manifold 9 by means of the conduit 40 and of the fan 41 and are then reintroduced into the zone 23 of the drum 2 by means of the recycling ring 26 and of the chutes 27.

The gases present in the zone 23 are drawn in by the turbine consisting of the fins 28 and are then delivered into the flame zone 22 where the flame 12 ensures their combustion.

The stirring and intimate mixing of the superheated virgin aggregates and of the preheated particles of recycled materials, in the zone 23, make possible the remelting of the bitumen present in the recycled materials and precoating of the virgin aggregates with the bitumen present in the recycled materials.

The precoated mixture then arrives at the zone 24 at the entry of which an addition of bitumen in controlled quantity and in divided form is provided by the lance 30.

The precoated particles are introduced into the zone 24 at a high temperature permitting the coating to be promoted when these particles are mixed with the liquid bitumen in the zone 24.

This high temperature of the precoated particles may be obtained without excessive superheating of the virgin aggregates insofar as the recycled materials introduced into the zone 23 are dry and at a temperature close to 100°C.

Pulverulent material can be added to the materials being coated in the zone 24 via the screw handling device 35.

At the exit of the zone 24, the bitumen-coated particles, containing a predetermined proportion of pulverulent material, are poured onto the conveyor 38 to be conveyed as far as the storage hopper 39.

The use of a drum drier into which the cold and wet recycled materials are introduced makes it possible to increase the quantity of recycled materials which is incorporated in the virgin aggregates, without any need for excessive superheating of these virgin aggregates.

The plant can thus be operated with a very high recycle ratio, possibly much higher than 40%, whatever the quantity of water present in the initial recycled materials.

In addition, the device according to the invention uses only two drums, to the exclusion of any stationary mixer and of means of storage and of measuring out to feed this stationary mixer. Consequently, the plants are simpler and less costly.

Figure 2:
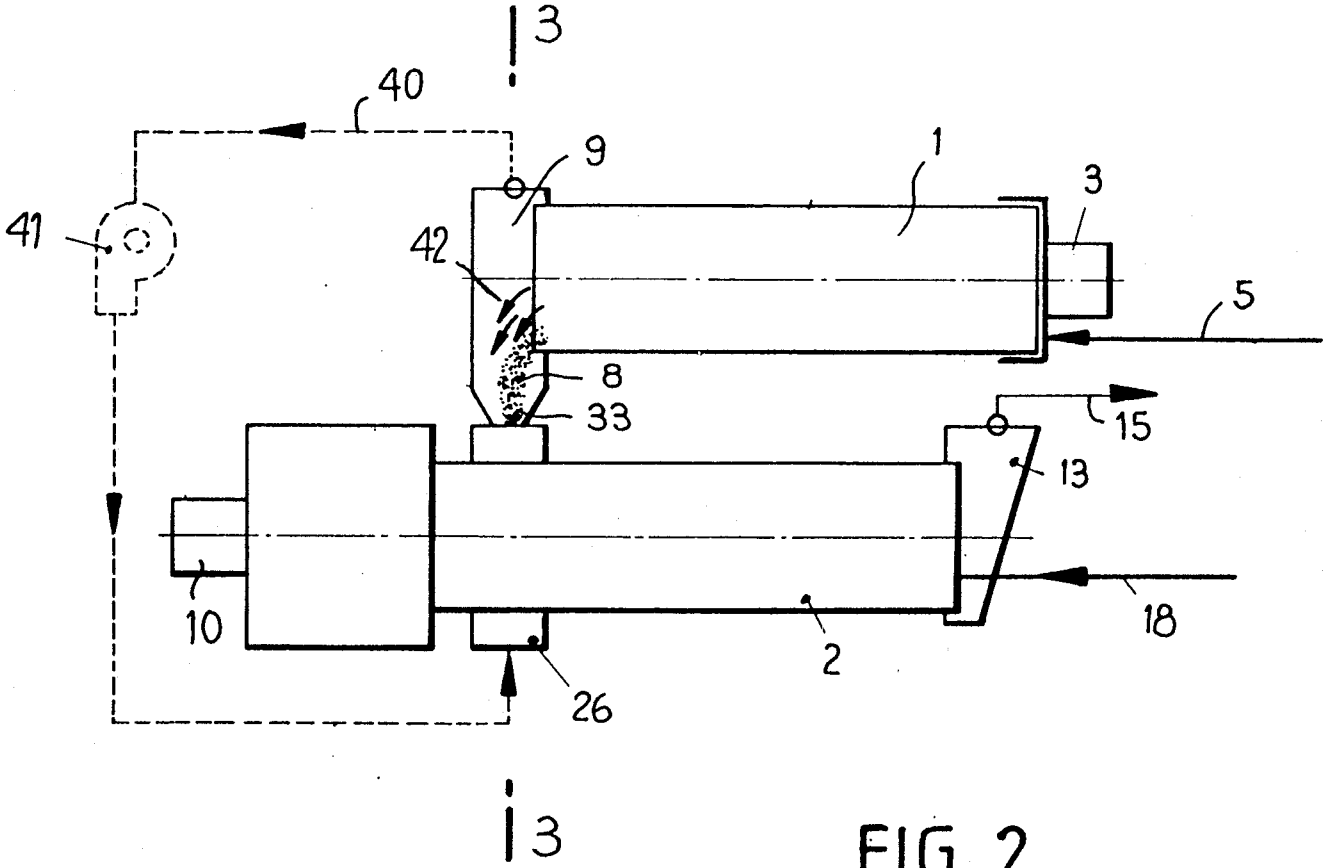
FIG. 2 is an elevation view of the two drums of the device in accordance with a second embodiment of the invention.
Figure 3:
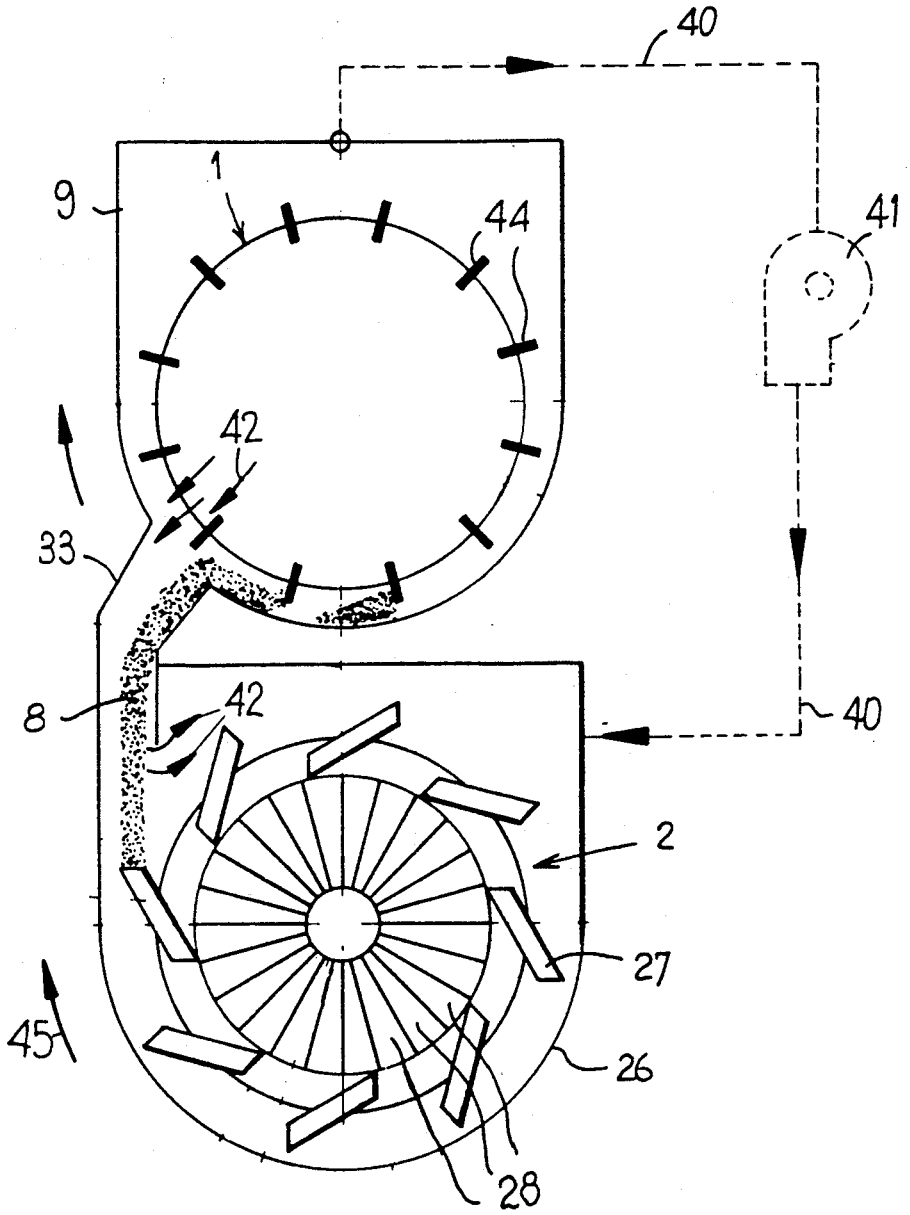
FIG. 3 is a section now along 3—3 of FIG. 2.

FIGS. 2 and 3 show a second embodiment of the device in accordance with the invention. The components corresponding to FIGS. 1 bear the same references.

The embodiment shown in FIGS. 2 and 3 differs from the embodiment just described with reference to FIG. 1 in that the drum drier 1 and the countercurrent drum 2 are arranged with their axes parallel, the drum 1 being placed vertically in line with and above the drum 2.

The manifold 9 placed at the exit of the drum drier 1 is arranged vertically in line with the recycling ring 26 of the drum 2. The device 33 responsible for conveying the dried and preheated recycled materials 8 between the manifold 9 and the recycling ring 26 consists of a simple chute 33 into which the particles 8 of recycled materials flow under gravity.

As can be seen in FIG. 3, the recycled materials 8 flow out of the drum 1 through openings provided in its wall, inside the manifold 9. The wall of the drum also carries flat paddles 44 inside the manifold 9, to promote the entrainment of the particles 8 of the recycled materials towards the entry of the chute 33. The materials 8 flowing under gravity into the chute 33 enter the recycling ring 26 and are guided by the chutes 27, integrally fixed to the wall of the drum, towards openings which pass through this wall, under the effect of the rotation of the drum 2 in the direction of the arrow 45. The materials 8 are thus introduced into the zone 23 of the drum 2.

The gases reaching the exit of the drum 1 escape into the manifold 9 via openings in the wall of the drum (arrows 42 in FIGS. 2 and 3) and can be introduced into the recycling ring 26 by means of the chute 33, these gases then entering the drum 2 level with the zone 23 via flow openings for the particles 8, situated in the extension of the chutes 27.

The gases are drawn by suction into the zone 23 and are delivered into the flame zone 22 by the fins 28 fixed to the casing 11 which is integrally fixed to the drum and arranged around the burner 10.

The gases arriving in the manifold 9 can also be drawn in by a fan 41 and delivered by this fan into the recycling ring 26, which is connected to the manifold 9 by a duct 40 in which the fan.. 41 is fitted.

Figure 4:
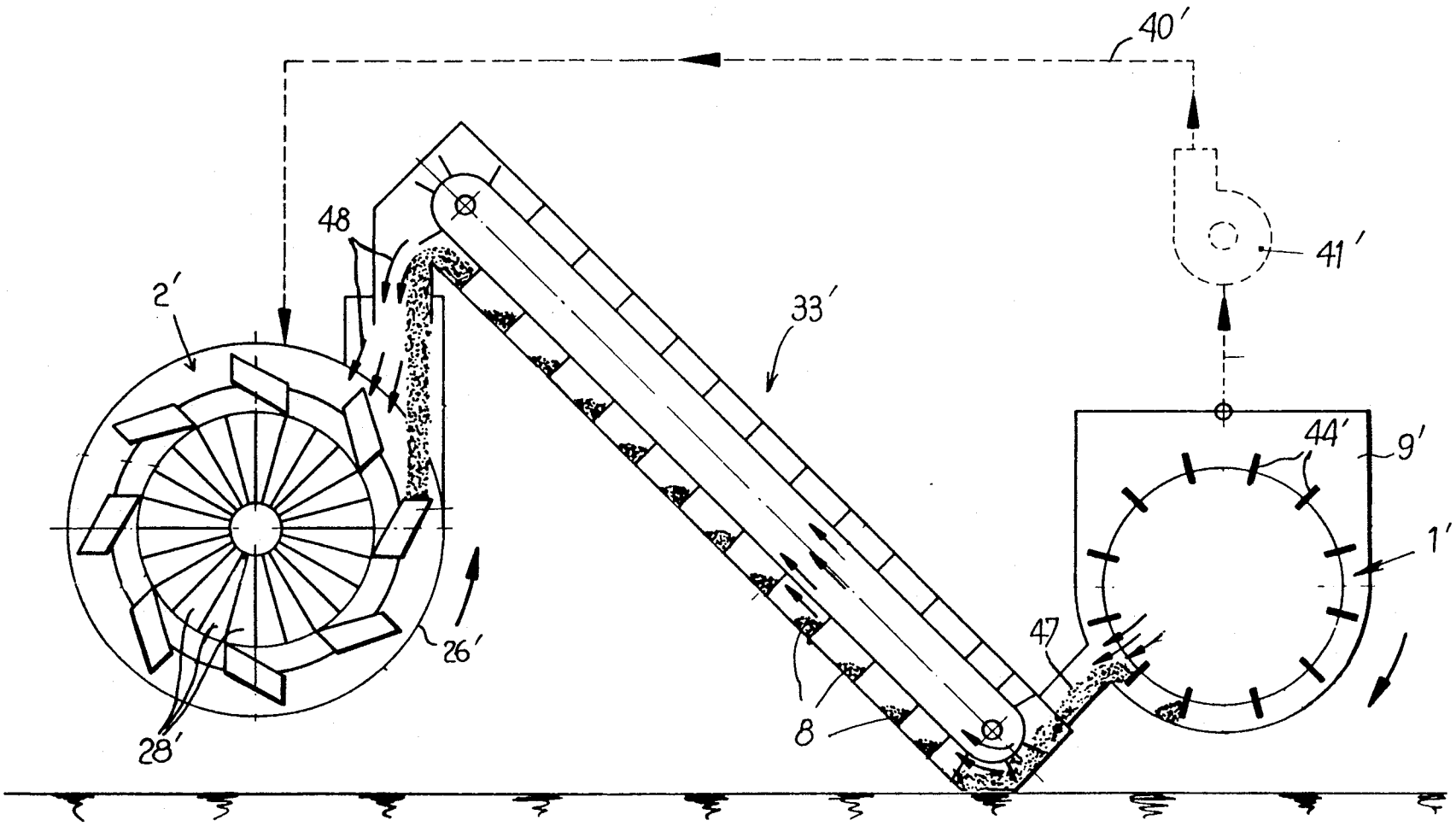
FIG. 4 is a section similar to FIG. 3, showing a third embodiment of the device in accordance with the invention.

FIG. 4 shows a third embodiment of the device in accordance with the invention, the corresponding elements in FIG. 4, bearing references which are the same as in FIG. 1 to 3 but which are followed by the exponent ′ (prime).

The device according to the third embodiment shown in FIG. 4 comprises two drums 1′ and 2′, with parallel streams and countercurrent, respectively, which are placed with their axes parallel and substantially at the same height.

The exit manifold 9′ of the drum 1′ is connected to the entry hopper of the recycling ring 26′ of the drum 2′ by a transporter device 33′ consisting of a sloping scraper conveyor comprising a caisson connected at its lower end to the manifold 9′ by a chute 47 and, at its upper end, to the hopper of the recycling ring 26′ by a chute 48. The dried and preheated recycled materials 8 overflow into the manifold 9′ through openings in the casing of the drum 1′. These materials then overflow into the chute 47 and into the lower part of the caisson of the scraper conveyor. The scraper conveyor is responsible for transferring the recycled materials 8 as far as the upper part of the caisson, where these materials overflow into the chute 48 and into the recycling ring 26′.

Paddles 44′ attached to the casing of the drum 1′ assure satisfactory overflow of the materials 8 into the chute 47.

The gases reaching the exit of the drum ′ can escape into the manifold 9′ through openings in the casing. These gases are drawn into the recycling and mixing zone of the drum 2′ by means of the chute 47, the caisson of the scraper conveyor 33′, chute 48 and recycling ring 26′.

These gases can also be introduced into the ring 26′ by a duct 40′ joining the manifold 9′ to the recycling ring 26′, in which a fan 41′ is placed.

The fins 28′ which are integrally fixed to the casing placed around the body of the burner are responsible for drawing gases into the recycling and mixing zone and for delivering these gases into the flame zone, under the effect of the rotation of the drum 2′.

Figure 5:
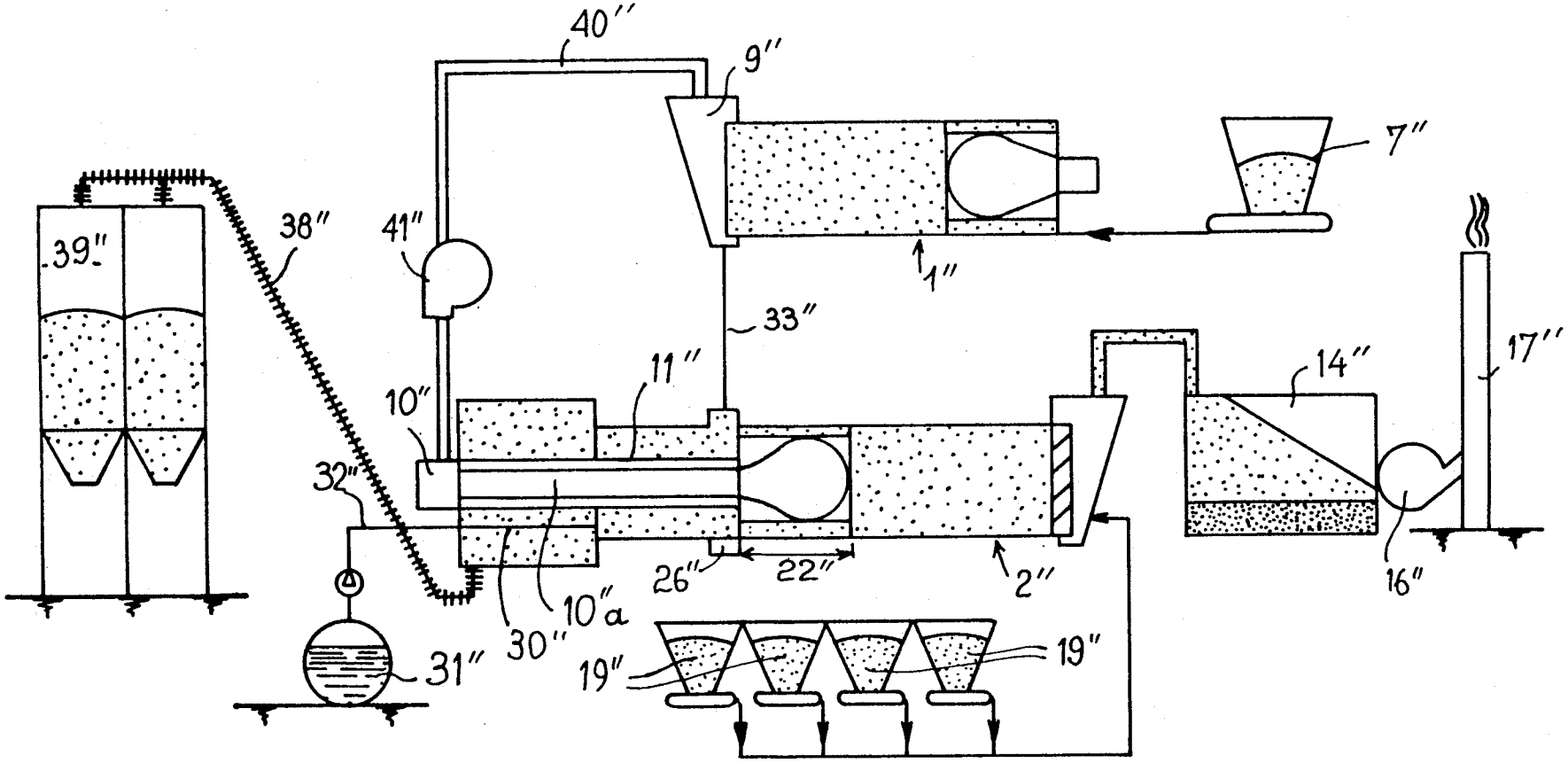
FIG. 5 is a schematic view, substantially similar to FIG. 1, of a plant in accordance with the invention, comprising means for recycling the gases from the drum with parallel streams into the burner of the countercurrent drum.

FIG. 5 shows a plant in accordance with the invention, which is by and large similar to the plant shown in FIG. 1 and which comprises a drum with parallel streams 1″ and a countercurrent drum 2″ whose relative arrangement is similar to the arrangement of the drums 1 and 2, shown in FIG. 2.

In this embodiment, the corresponding elements in FIG. 5 bear the same references as those in FIG. 1, but are double primed (″). The members of the device of FIG. 5 which are similar to the members of the device of FIG. 1 will not be described in detail, since it will suffice to refer to the description relating to FIG. 1.

In addition, the recycled materials recovered at the exit of the drum 1'' in the manifold 9'' spill into the recycling ring 26'' of the drum 2'' by means of the conduit 33'', in a manner which is similar to that in the embodiment shown in FIG. 2.

In distinction to the embodiment shown in FIG. 1, the gases recovered at the exit of the drum 1'' in the manifold 9'' are not introduced into the drum 2'' level with the recycling ring 26'', but into the burner 10'', so as to enter the inside of the drum as far as the flame zone 22'', through the annular space between the body of the burner **10*a*'' integrally fixed to the stationary part of the drum 2'' and the casing 11''** integrally fixed to the rotating part of the drum.

The recovered gases are injected into the burner 10'' by means of the conduit 40'' in which a fan 41'' is placed.

In this way the gases, which may contain a certain proportion of hydrocarbon vapor, are burnt in the flame 12''.

In all cases, the device in accordance with the invention makes it possible to carry out the production of bituminous coated materials from solid materials containing a high proportion of recycled materials, whatever the moisture content of the initial recycled materials.

It is possible to use arrangements other than the drum with parallel streams and the countercurrent drum, as well as conveying means other than those described for ensuring the flow of the dried and preheated coated materials from the first drum to the recycling ring of the second drum.

The device according to the invention applies generally to all cases where bituminous coated products are produced from recycled bituminous materials, virgin aggregates and liquid bitumen.

I claim:

1. Device for preparing bituminous coated products from recycled materials, virgin aggregates and liquid bitumen, said device comprising (a) a parallel flow drum having an entry end, means for feeding said entry end with recycled materials, a burner entering through said entry end, and an exit end for discharging dried and heated recycled materials;

(b) a countercurrent drum having an entry end, means for feeding said entry end with cold virgin aggregates, an exit end, an elongate burner entering said countercurrent drum through its said exit end and opening into a flame zone distant from both ends of said countercurrent drum, a ring arranged around a side wall of said countercurrent drum and having apertures for introducing materials through said side wall, a device for injecting bitumen in an mixing zone of said countercurrent drum situated around said elongate burner and adjoining said exit end of said countercurrent drum; and (c) material transfer means connected both to said exit end of said parallel flow drum and to said ring of said countercurrent drum for introducing heated and dried recycled materials into said ring and through said apertures within said side wall of said countercurrent drum, into a recycling and mixing zone situated in said countercurrent drum between said flame zone and said mixing zone.

2. Device according to claim 1, comprising means for recovering hot gases connected to said exit end of said parallel flow drum and to said ring of said countercurrent drum.

3. Device according to claim 2, wherein said means for recovering hot gases consist of a conduit connecting a manifold for recovering said gases from said exit end of said parallel flow drum to said ring of said countercurrent drum, and a fan is arranged in said conduit, enabling said gases in said manifold to be drawn in from said exit end of said parallel flow drum and to be delivered into said ring of said countercurrent drum.

4. Device according to claim 1, wherein said parallel flow drum and said countercurrent drum are generally cylindrical and have longitudinal axes forming small angles relative to a horizontal plane, said parallel flow drum being disposed vertically above said countercurrent drum and having its said exit end opening into a manifold located in vertical alignment with said ring of said countercurrent drum and connected to said ring by a chute constituting a means for transferring materials from said parallel flow drum to said ring of said countercurrent drum.

5. Device according to claim 1, wherein said device for transferring recycled materials between said exit end of said parallel flow drum and said ring of said countercurrent drum consists of a conveyor comprising a caisson inclined relative to a horizontal plane, said caisson having a lower end connected to a manifold into which opens said exit end of said parallel flow drum and an upper end connected by means of a hopper to said ring of said countercurrent drum.

6. Device according to claim 1, wherein said elongate body of said burner is placed inside a tubular casing along its entire length, said casing being internally fixed to said side wall of said countercurrent drum and, at an end opening into said flame zone of said countercurrent drum, carrying fins disposed radially relative to said countercurrent drum between said casing of said burner and said casing of the drum and inclined relative to said longitudinal axis of said cuontercurrent drum, so as to form a turbine for drawing in said gases from said recycling and mixing zone and delivering said gases into said flame zone.

7. Process for preparing bituminous coated products from recycled bituminous materials, virgin aggregates and liquid bitumen, said process comprising the steps of (a) continuously drying and heating said recycled materials in a parallel flow drum in which said recycled materials travel in a same direction as a stream of hot gases;

(b) continuously drying and heating virgin aggregates in a countercurrent drum in which said virgin aggregates travel countercurrentwise to hot gases;

(c) mixing said virgin aggregates and said dried and heated recycled materials with one another and with liquid bitumen;

(d) wherein said recycled materials dried and heated in said parallel flow drum are continuously transferred into a recycling and mixing zone of said countercurrent drum in which said dried and heated virgin aggregates arrive, said liquid bitumen is incorporated in the mixture of recycled materials and of virgin aggregates, and mixing is performed in a zone of said countercurrent drum which is downstream of said recycling and mixing zone in a direction of travel of said aggregates.

8. Process according to claim 7, wherein said hot gases recovered at an exit end of said parallel flow drum and which have travelled in contact with said recycled aggregates are introduced into said countercurrent drum so that said gases are brought into contact with a flame of said countercurrent drum and are burnt.

* * * * *